United States Patent [19]

Kohmura et al.

[11] 4,302,526

[45] Nov. 24, 1981

[54] MATERIALS FOR SILVER COMPLEX DIFFUSION TRANSFER PROCESS

[75] Inventors: Isao Kohmura; Tamotsu Iwata; Shozi Oka, all of Nagaokakyo, Japan

[73] Assignee: Mitsubishi Paper Mills, Ltd., Tokyo, Japan

[21] Appl. No.: 91,754

[22] Filed: Nov. 6, 1979

[30] Foreign Application Priority Data

Nov. 11, 1978 [JP] Japan ..... 53-139270

[51] Int. Cl.[3] ..... G03C 1/48; G03C 1/84; G03C 5/54; G03C 1/76

[52] U.S. Cl. ..... 430/227; 430/230; 430/231; 430/232; 430/510; 430/523; 430/531; 530/536; 430/539; 430/567; 430/642

[58] Field of Search ..... 430/227, 230, 232, 510, 430/517, 523, 539, 531, 536, 537, 567, 564, 642, 639, 641, 643

[56] References Cited

U.S. PATENT DOCUMENTS 3,364,024 1/1968 Yackel et al. ..... 430/202
3,436,217 4/1969 Kleist et al. ..... 430/230
3,615,535 10/1971 Smith et al. ..... 430/249
4,144,064 3/1979 Vermeulen et al. ..... 430/227
4,149,889 4/1979 Yoshida et al. ..... 430/230

*Primary Examiner*—Richard L. Schilling
*Attorney, Agent, or Firm*—Cushman, Darby & Cushman

[57] ABSTRACT

The negative materials of this invention for silver complex diffusion transfer process provide silver images high in density and improved in stability on image receiving materials. Said negative materials have the following characteristics:

(a) The negative materials have silver halide emulsion layer in which the weight ratio of hydrophilic colloid to silver halide in terms of silver nitrate is 2 or less and (b) furthermore, the negative materials have an undercoat layer of hydrophilic colloid on a support and the silver halide emulsion layer of (a) on said undercoat layer, the weight ratio of the hydrophilic colloid of said undercoat layer to that of said silver halide emulsion layer being at least 2.

7 Claims, No Drawings

MATERIALS FOR SILVER COMPLEX DIFFUSION TRANSFER PROCESS

BACKGROUND OF THE INVENTION

This invention relates to silver complex diffusion transfer materials and more particularly to negative materials which are to be subjected to silver complex diffusion transfer development in combination with positive materials.

In silver complex diffusion transfer processes, there are generally used a negative material comprising a support and silver halide emulsion layers coated thereon, a positive material comprising a support and an image receiving layer containing physical development nuclei coated thereon and a processing solution containing a silver halide solvent. That is, exposed silver halide of exposed negative material is developed (chemically) with developing agent in the processing solution or in the negative material and simultaneously silver halide of unexposed area reacts with the silver halide solvent in the processing solution to form a soluble silver complex which diffuses to the positive material (image receiving material) where it precipitates on physical development nuclei to form silver images.

Qualities of final images such as density, color tone, contrast, storage stability, etc. are important in such silver complex diffusion transfer process. Depending on uses, a continuous tone original is reproduced on the image receiving material and the higher contrast, sharpness and resolving power are required for using it as reproduction of documents, printed matters, etc. or as block copies for printing plate making. Furthermore, the recent silver complex diffusion transfer development which is designed to obtain higher transfer efficiency, namely, to complete the transfer in 5–15 seconds necessitates obtaining sufficient transfer density in a short time.

Silver complex forming agents necessary for dissolving unexposed, namely, undeveloped silver halide, especially sodium thiosulfate are usually incorporated in the processing solution or image receiving materials. Therefore, the positive material on which an image has been formed contains at least some sodium thiosulfate, which decreases concentration of silver ion to cause increase of oxidation potential of metallic silver. As a result, the silver image is oxidized and becomes liable to conversion to a double salt or a simple silver salt. This brings about disappearance of the silver image or change in color of the image to brown especially in an atmosphere of high humidity.

The silver image of such portion where only a small amount of silver is precipitated due to the short transfer time is especially liable to disappear. This defect is accelerated in the case of the closed system where both the negative and positive materials have water impermeable supports and diffusion of the processing solution is restrained.

For obtaining further higher sharpness and resolving power, it is well known to allow carbon black, pigments, dyes, etc. to be present in silver halide photographic materials. However, when these substances are contained in silver halide emulsion layers, loss of sensitivity is too much and so they are preferably present in the layers other than the silver halide emulsion layer.

SUMMARY OF THE INVENTION

It is an object of this invention to provide negative materials for a silver complex diffusion transfer process which provide silver images high in transfer density and improved in stability on the receiving materials.

Another object of this invention is to provide negative materials for silver complex diffusion transfer process which have high sensitivity, contrast, sharpness and resolving power, which provide high transfer density on image receiving materials by rapid processing and improved silver image stability on the receiving materials and which is suitable for rapid processing.

Other objects and advantages of the invention will become apparent from the following description.

DESCRIPTION OF THE INVENTION

In accordance with this invention, it has been found that the above and other objects of this invention can be obtained with negative materials having the following characteristics.

(a) The negative materials have silver halide emulsion layer in which the weight ratio of hydrophilic colloid substance to silver halide in terms of silver nitrate is 2 or less.

(b) Furthermore, the negative materials have an undercoat layer of hydrophilic colloid substance on a support and the silver halide emulsion layer of (a) on said undercoat layer, the weight ratio of the hydrophilic colloid substance in said undercoat layer to that in said silver halide emulsion layer being at least 2.

General negative materials for silver complex diffusion transfer process comprise at least one silver halide emulsion layer provided on a support and the silver halide is generally coated in an amount of 0.5 g–3.5 g/m$^2$ in terms of silver nitrate. It is also known that if necessary, auxiliary layers such as undercoat layer, interlayer, protective layer, peel layer and the like are provided besides the silver halide emulsion layer. Generally, these auxiliary layers have a thickness the same as or less than that of the silver halide emulsion layer. For example, the negative materials of this invention can have a layer of water permeable binders as mentioned in Japanese Patent Publications No. 18134/63 and No. 18135/63, e.g., sodium salts of methylcellulose and carboxymethylcellulose, sodium alginate, etc. as a covering layer for the silver halide emulsion layer to homogenize the transfer process. This layer should be thin not so as to substantially prevent or restrain the diffusion.

In this invention, the weight ratio of hydrophilic colloid substance to silver halide in silver halide emulsion layer is at most 2, especially preferably 0.5–1.5. Furthermore, the weight ratio of hydrophilic colloid substance in undercoat layer to hydrophilic colloid substance in silver halide emulsion layer is at least 2, preferably less than about 5.

Each of the silver halide emulsion layer and undercoat layer in the negative materials of this invention and image receiving layer in positive materials contains at least one hydrophilic polymeric colloid substance, e.g., gelatin, gelatin derivatives such as phthalated gelatin, cellulose derivatives such as carboxymethylcellulose and hydroxymethylcellulose, dextrin, soluble starches, polyvinyl alcohol, polystryenesulfonic acid, etc. The coating amount of the hydrophilic colloid substance used in the positive materials may generally be about 1–10 g/m² or more. The negative materials of this invention can be freely changed in their constructions depending on the coating amount of the hydrophilic colloid substance in the positive materials or constructions of the positive materials. In a preferred embodiment, the total amount of hydrophilic colloid substance per unit area of the positive materials is smaller than the total amount of hydrophilic colloid substances per unit area of the negative materials.

The silver halide emulsion comprises silver halides, e.g., silver chloride, silver bromide, silver chlorobromide, and those additionally containing iodides such as silver iodobromide, etc. which are dispersed in said hydrophilic colloid. The silver halide emulsion can be sensitized by various methods at the time of preparation or coating. For example, the emulsion may be chemically sensitized by the well known methods using e.g., sodium thiosulfate, alkylthiourea or gold compounds such as gold rhodanide, gold chloride or combination thereof. The emulsion can be usually further sensitized to the range of about 530 nm–about 560 nm and it can also be panchromatically sensitized.

The negative materials and/or positive materials can contain any compounds which are ordinarily used for carrying out silver complex diffusion transfer process. Examples of these compounds are developing substances (e.g., preferably 0.3–3 g/m² of hydroquinone and/or 0.075–1.5 g/m² of 1-phenyl-3-pyrazolidone and aminophenols or derivatives thereof), anti-fogging agents such as tetrazinedene, mercaptotetrazoles, etc., coating assistants such as saponin, polyalkylene oxides, hardeners such as formalin, chrome alum, plasticizers, etc. In this invention, the undercoat layer of the negative materials can contain substances such as dyes, pigments and the like which absorb unnecessary light. Containment of pigments in the undercoat layer as mentioned above can be included in the object of this invention.

The supports used in the negative materials or image receiving materials according to this invention may be any ordinarily used supports. Examples of the supports are paper, glass, films such as cellulose acetate film, polyvinyl acetal film, polystyrene film, polyethylene terephthalate film, etc., metallic supports both surfaces of which are coated with paper, paper supports one or both surfaces of which are coated with α-olefin polymer such as polyethylene. However, this invention is especially suitable to water impermeable supports as mentioned above. The image receiving materials can contain physical development nuclei such as heavy metals or sulfides thereof. At least one layer of the image receiving materials may contain substances which play a conspicuous role for formation of diffusion transfer images, e.g., black toners as mentioned in British Pat. No. 561875 and Belgian Pat. No. 502525 such as 1-phenyl-5-mercaptotetrazole. The receiving materials may also contain fixers such as sodium thiosulfate in an amount of about 0.1—about 4 g/m². The developing substances can also be contained in such image receiving materials as described in Japanese Patent Publication No. 27568/64.

Processing solutions used in this invention may usually contain alkaline substances such as tribasic sodium phosphate, potassium hydroxide, etc., preservatives such as sodium sulfite, tackifiers such as hydroxyethylcellulose, carboxymethylcellulose, anti-fogging agents such as potassium bromide, developing substances such as hydroquinone, development nuclei and silver halide solvents such as sodium thiosulfate.

The following examples are included for a further understanding of the invention.

EXAMPLE 1

An image receiving layer comprising gelatin and carboxymethylcellulose (4:1) and containing nickel sulfide nuclei was provided on one side of a paper support of 110 g/m² both surfaces of which were covered with polyethylene so that dry weight of hydrophilic colloid was 3 g/m² to obtain positive materials.

On the same paper support as used for preparation of said positive materials was provided an undercoat layer containing carbon black for prevention of halation. On said undercoat layer was provided an orthochromatically sensitized gelatin silver halide emulsion layer containing 1.5 g/m² (in terms of silver nitrate) of silver chlorobromide (silver bromide 10 mol%) of 0.3μ in mean particle diameter and additionally containing 0.2 g/m² of 1-phenyl-4-methyl-pyrazolidone and 0.7 g/m² of hydroquinone, etc. to obtain four negative materials. These four negative materials were different from each other only in the amounts of gelatin in the undercoat layer and the emulsion layer as shown in the following Table 1.

TABLE 1

| Negative materials | Colloid in the undercoat layer (g/m²) | Gelatin in the emulsion layer (g/m²) | |
|---|---|---|---|
| A | 1.5 | 1.0 | Not this invention |
| B | 3.0 | 1.0 | This invention |
| C | 1.5 | 1.5 | Not this invention |
| D | 3.0 | 1.5 | This invention |

Thus obtained negative materials were subjected to imagewise exposure. Then, the surface of emulsion layer of said negative materials and that of image receiving layer of said positive materials were allowed to contact with each other and they were passed through a usual developing machine having a silver complex diffusion transfer developing solution of the following composition and the negative material and the positive material were separated from each other after 15 seconds from their leaving a squeezing roller.

| | |
|---|---|
| Water | 800 ml |
| Tribasic sodium phosphate 12 hydrate | 75 g |
| Anhydrous sodium sulfite | 40 g |
| Potassium bromide | 0.5 g |
| Anhydrous sodium thiosulfate | 20 g |
| 1-Phenyl-5-mercaptotetrazole | 70 mg |
| Water to make 1 l | |

A part of each positive material (copy) obtained using the negative materials A–D was immediately put in a sealed polyethylene bag and was left to stand for 3 days under 50° C., 80% RH. Thereafter, stability of density of silver image was examined. The results are shown in Table 2.

TABLE 2

| | Density immediately after production | Density after being left to stand as above |
|---|---|---|
| Copy obtained using negative material A | 1,24 | 0.95 |
| Copy obtained using negative material B | 1.30 | 1.26 |
| Copy obtained using negative material C | 1.19 | 0.93 |
| Copy obtained using negative material D | 1.21 | 1.17 |

Copies obtained using negative materials B and D had sharp images which had a high contrast to white ground and high black density. Quality of the copies was stable even after storage.

EXAMPLE 2

In the same manner as in Example 1, on the same paper support as used therein was provided an image receiving layer containing palladium sulfide nuclei so that the amount of hydrophilic colloid was 6 g/m$^2$ to obtain positive materials. Furthermore, negative materials were produced in the same manner as for Example 1 except that the undercoat layer contained 6 g/m$^2$ of gelatin and that the silver halide emulsion layer contained 2.0 g/m$^2$ of silver chloride in terms of silver nitrate and gelatin in the amount as shown in Table 3. Furthermore, in the same manner, negative materials which had no undercoat layer and in which contents of gelatin were 1.5, 4.5 and 9 g/m$^2$ were also produced (but developing substances were all contained in the emulsion layers).

TABLE 3

| Negative materials | Colloid in the undercoat layer (g/m$^2$) | Gelatin in the emulsion layer (g/m$^2$) | |
|---|---|---|---|
| E | 6 | 1.5 | This invention |
| F | 6 | 3.0 | This invention |
| G | 6 | 4.5 | Not this invention |
| H | — | 1.5 | Not this invention |
| I | — | 4.5 | Not this invention |
| J | — | 9.0 | Not this invention |

Results of tests conducted as in Example 1 are shown in Table 4.

TABLE 4

| | Density immediately after production | Density after being left to stand |
|---|---|---|
| Copy obtained using negative material E | 1.55 | 1.48 |
| Copy obtained using negative material F | 1.51 | 1.46 |
| Copy obtained using negative material G | 1.32 | 1.25 |
| Copy obtained using negative material H | 1.11 | 0.85 |
| Copy obtained using negative material I | 1.27 | 1.01 |
| Copy obtained using negative material J | 1.04 | 0.93 |

Copies obtained using negative materials E and F had sharp images which had a high contrast to the white ground and a high black density and the quality of which was stable even when they were stored under high humidity conditions. Copies obtained using negative materials G-J were inferior in density and storage stability. Negative material H was conspicuous in the defect of separation of hydroquinone crystal.

EXAMPLE 3

Negative materials were produced in the same manner as in Example 1 except that they did not contain a developing agent in the emulsion layer. They were processed with the following transfer developing solution to obtain the same results as of Example 1.

| | |
|---|---|
| Water | 800 ml |
| Sodium hydroxide | 10 g |
| Anhydrous sodium sulfite | 75 g |
| Potassium bromide | 1 g |
| Hydroquinone | 16 g |
| 1-Phenyl-3-pyrazolidone | 1 g |
| Anhydrous sodium thiosulfate | 10 g |
| Water to make 1 l | |

EXAMPLE 4

An image receiving layer comprising gelatin and carboxymethylcellulose (4:1) and containing nickel sulfide nuclei was provided on one side of a paper support of 110 g/m$^2$ both surfaces of which were covered with polyethylene so that dry weight of hydrophilic colloid was 3 g/m$^2$ to obtain positive materials.

On the same paper support as used for preparation of said positive materials was provided a gelatin undercoat layer containing carbon black for prevention of halation, 1 g/m$^2$ of hydroquinone and 0.3 g/m$^2$ of 1-phenyl-4-methyl-3-pyrazolidone. On said undercoat layer was provided orthochromatically sensitized gelatin silver halide emulsion layer containing 1.5 g/m$^2$ (in terms of silver nitrate) of silver chlorobromide (silver bromide 15 mol%) of 0.3$\mu$ in mean particle diameter and additionally containing 0.2 g/m$^2$ of hydroquinone, etc. to obtain four negative materials. These four negative materials were different from each other only in the amounts of gelatin in the undercoat layer and the emulsion layer as shown in the following Table 5.

TABLE 5

| Negative material | Colloid in the undercoat layer (g/m$^2$) | Gelatin in the emulsion layer (g/m$^2$) | |
|---|---|---|---|
| K | 1.5 | 1.0 | Not this invention |
| L | 3.0 | 1.0 | This invention |
| M | 1.5 | 1.5 | Not this invention |
| N | 3.0 | 1.5 | This invention |

Thus obtained negative materials were subjected to imagewise exposure. Then, the surface of emulsion layer of said negative materials and that of image receiving layer of said positive materials were allowed to contact with each other and they were passed through a usual developing machine having a silver complex diffusion transfer developing solution of the following composition and the negative material and the positive material were separated from each other after 15 seconds from their leaving a squeezing roller.

| | |
|---|---|
| Water | 800 ml |
| Tribasic sodium phosphate 12 hydrate | 75 g |
| Anhydrous sodium sulfite | 40 g |
| Potassium bromide | 0.5 g |
| Anhydrous sodium thiosulfate | 20 g |
| 1-Phenyl-5-mercaptotetrazole | 70 mg |
| Water to make 1 l | |

A part of each positive material (copy) obtained using the negative materials K-N was immediately put in a sealed polyethylene bag and was left to stand for 3 days under 50° C., 80% RH. Thereafter, stability of density of silver image was examined. The results are shown in Table 6.

TABLE 6

| | Density immediately after production | Density after being left to stand as above |
|---|---|---|
| Copy obtained using negative material K | 1.29 | 0.96 |
| Copy obtained using negative material L | 1.32 | 1.29 |
| Copy obtained using negative material M | 1.26 | 1.01 |
| Copy obtained using negative material N | 1.27 | 1.25 |

Copies obtained using negative materials L and N had sharp images which had a high contrast to white ground and high black density and the quality of which was stable after storage. On the other hand, copies obtained using negative materials K and M resulted in great decrease in density after storage.

Photographic characteristics of said negative materials K-M which are stored for 48 hours under 50° C., 80% RH were measured to find that none of these negatives showed any increase in fog as compared with those immediately after production and there was no separation of crystal of developing agent and thus they were stable.

What is claimed is:

1. A photographic product which comprises in combination, a negative material for silver complex diffusion transfer process which has silver halide emulsion layer which is developed in contact with an image receiving material having an image receiving layer the improvement comprising (a) in said silver halide emulsion layer the weight ratio of hydrophilic colloid substance to silver halide in terms of silver nitrate being 2 or less and (b) an undercoat layer of hydrophilic colloid substance provided on a support and said silver halide emulsion layer provided on said undercoat layer, the weight ratio of hydrophilic colloid substance in said undercoat layer to hydrophilic colloid substance in said silver halide emulsion layer being at least 3, a processing solution which is an aqueous alkaline solution containing a silver complex forming agent and an image receiving material containing physical development nuclei.

2. A photographic product according to claim 1, wherein the undercoat layer is an antihalation layer.

3. A photographic product according to claim 1 or 2, wherein the weight ratio of hydrophilic colloid substance to silver halide in (a) is 0.5–1.5.

4. A photographic product according to claim 1 or 2, wherein the weight ratio of the hydropholic colloid substances in (b) is 3–5.

5. A photographic product according to claim 1, wherein the total amount of hydrophilic colloid substance per unit area on the image receiving material is smaller than the total amount of hydrophilic colloid substance per unit area on the negative material.

6. A photographic product according to claim 1, wherein both the supports of the negative material and the image receiving material are water impermeable supports.

7. A photographic product according to claim 1 or 2 which has at least one auxiliary layers in addition to the undercoat layer and the emulsion layer.

* * * * *